US005205030A

United States Patent [19]

Uno

[11] Patent Number: 5,205,030

[45] Date of Patent: Apr. 27, 1993

[54] RIVET HEAD CAULKING MACHINE

[75] Inventor: Wataru Uno, Higashiosaka, Japan

[73] Assignee: Yoshikawa Iron Works Ltd., Osaka, Japan

[21] Appl. No.: 724,816

[22] Filed: Jul. 2, 1991

[30] Foreign Application Priority Data

Jul. 2, 1990 [JP] Japan ..... 2-176084

[51] Int. Cl.[5] ..... B23P 21/00

[52] U.S. Cl. ..... 29/707; 29/714; 29/715; 29/243.5; 29/243.53

[58] Field of Search ..... 29/707, 714, 715, 243.5, 29/243.53, 243.54, 283.5, 712; 227/51

[56] References Cited

U.S. PATENT DOCUMENTS

| | | | |
|---|---|---|---|
| 3,800,579 | 4/1974 | Breiter | 29/243.53 |
| 3,999,274 | 12/1976 | Butler | 29/243.53 |
| 4,041,596 | 8/1977 | Mink | 29/243.53 |
| 4,650,995 | 3/1987 | Tokunaga et al. | 324/175 |
| 4,870,270 | 9/1989 | Brennan | 324/175 |

FOREIGN PATENT DOCUMENTS

| | | | |
|---|---|---|---|
| 220933 | 9/1988 | Japan | 29/715 |
| 160127 | 6/1990 | Japan | 29/714 |

*Primary Examiner*—P. W. Echols
*Assistant Examiner*—David P. Bryant
*Attorney, Agent, or Firm*—Wenderoth, Lind & Ponack

[57] ABSTRACT

A caulking machine has a column with a table for placing a work piece having rivet shanks passing therethrough, a cylinder vertically movably mounted on the column, a piston shaft fixedly mounted in the cylinder so as to be movable together with the cylinder, a spindle rotatably mounted in the piston shaft, and a rivet head forming tool having a forming shaft and mounted to the bottom end of the spindle. The forming shaft is adapted to be pressed against the rivet shank in the work piece by operating the cylinder, and can be rotated by a motor via the spindle to form a rivet head on the rivet shank. The machine has a rotation detector for determining whether a rivet head is being formed or the machine is idling by measuring the rotation of the forming shaft. If it is determined that the machine is idling, a display device can be activated and the operation of the machine can be stopped.

5 Claims, 3 Drawing Sheets

RIVET HEAD CAULKING MACHINE

BACKGROUND OF THE INVENTION

This invention relates to a rivet head caulking machine provided with a rivet detector.

As shown in FIG. 4, in a prior art caulking machine, after placing a part to be worked having a plurality of rivet shanks passing therethrough on a table 2 of a column 1, a piston shaft 4 is lowered by a cylinder 3 mounted on the column 1.

A spindle 6 is rotatably and coaxially mounted to the piston shaft 4. It is driven by a motor 5 mounted on the top end of the piston shaft 4. On the bottom end of the spindle 6 is mounted a rivet head forming tool 8 having a forming shaft 7 for forming a rivet head on the rivet shank.

The work piece having rivet shanks passing therethrough to secure parts together is set on a table which is moved in both X and Y directions so that the rivets will come under the head of the caulking machine one after another.

Since this machine is not provided with means for detecting the existence of a river shank, it is impossible to check whether a rivet head is being formed or the spindle is idling with no rivet in place. Therefore, an operator had to check whether or not there was a rivet shank in place. Should the rivet head forming tool lower onto the work with no rivet shank present, the work piece might get marred.

If the parts to be secured together have a great number of rivet shanks passed therethrough, such visual checking is quite troublesome and thus is extremely inefficient.

SUMMARY OF THE INVENTION

It is an object of this invention to provide a rivet head caulking machine which can check whether or not there is a rivet shank in place.

In accordance with the present invention, there is provided a rivet head caulking machine comprising a column having a table for placing a work piece, having rivet shanks passing therethrough, a cylinder vertically movably mounted on the column, a piston shaft fixedly mounted in the cylinder so as to be movable together with the cylinder, a spindle rotatably mounted to the piston shaft, a rivet head forming tool having a forming shaft and secured to the bottom end of the spindle, the forming shaft being adapted to be pressed against the rivet shanks in the work piece by the cylinder and rotated by the motor via the spindle to form a rivet head on the rivet shanks, a rivet detecting means for judging whether a rivet head is being formed or the caulking machine is idling with no rivet present by measuring the rotation of the forming shaft, and means for activating a display device or stopping the operation of the caulking machine if the rivet detecting means detects that the caulking machine is idling.

Ideally, when a rivet head is being formed by pressing the forming shaft of the rivet head forming tool against the rivet shank, the forming shaft should not rotate at all during rotation of the forming tool (in other words, the forming surface of the forming shaft should not slip on the rivet head being formed). Otherwise, its rotation, if any, should be negligibly small.

In contrast, during idling, the forming shaft makes one rotation for every rotation of the rivet head forming tool. Thus, by measuring the rotation of the forming shaft with the detecting means, it can be checked whether the rivet head is being formed or the machine is idling. If the caulking machine is judged to be idling, this fact may be indicated on a display device and the operation of the machine may be stopped.

This relieves an operator of the work of checking whether or not there is a rivet in place and thus improves the efficiency of the caulking operation.

BRIEF DESCRIPTION OF THE DRAWINGS

Other features and objects of the present invention will become apparent from the following description taken with reference to the accompanying drawings, in which.

DETAILED DESCRIPTION OF THE INVENTION

Figure 1:
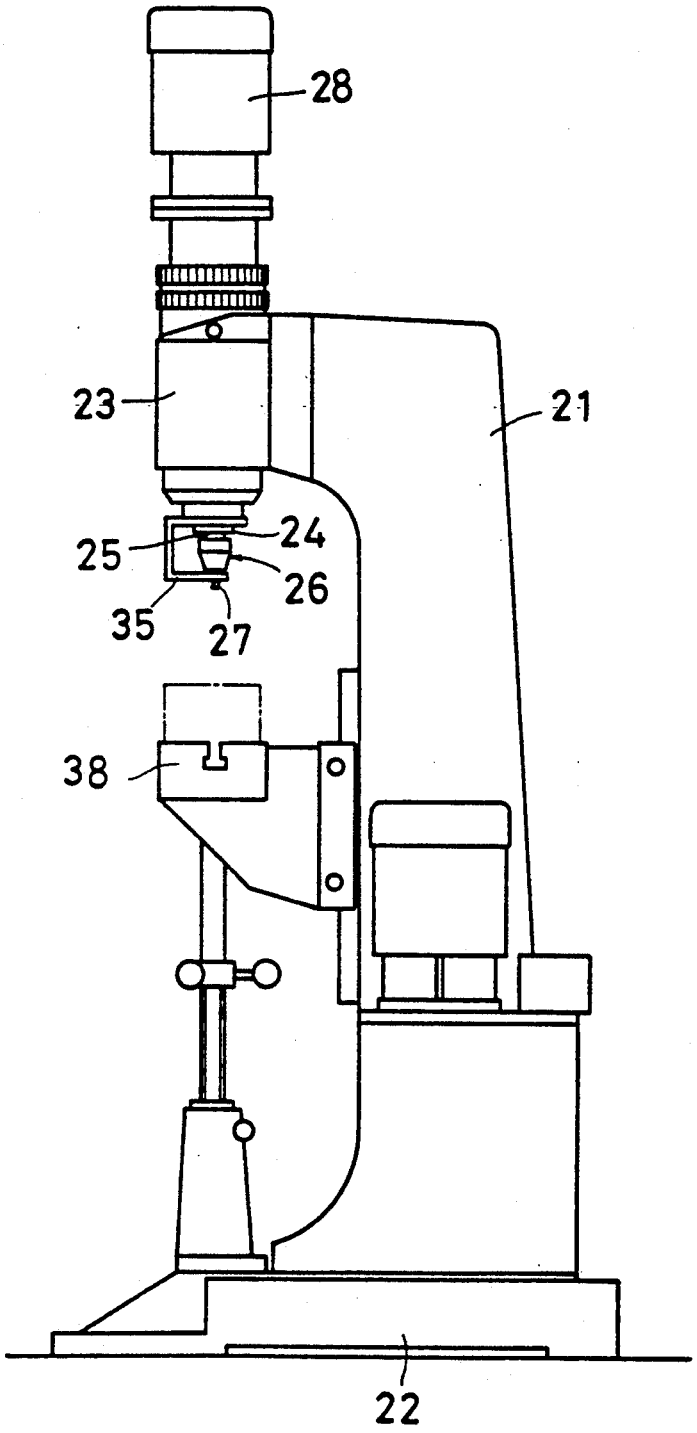
FIG. 1 is a side view of the caulking machine embodying this invention.
Figure 2:
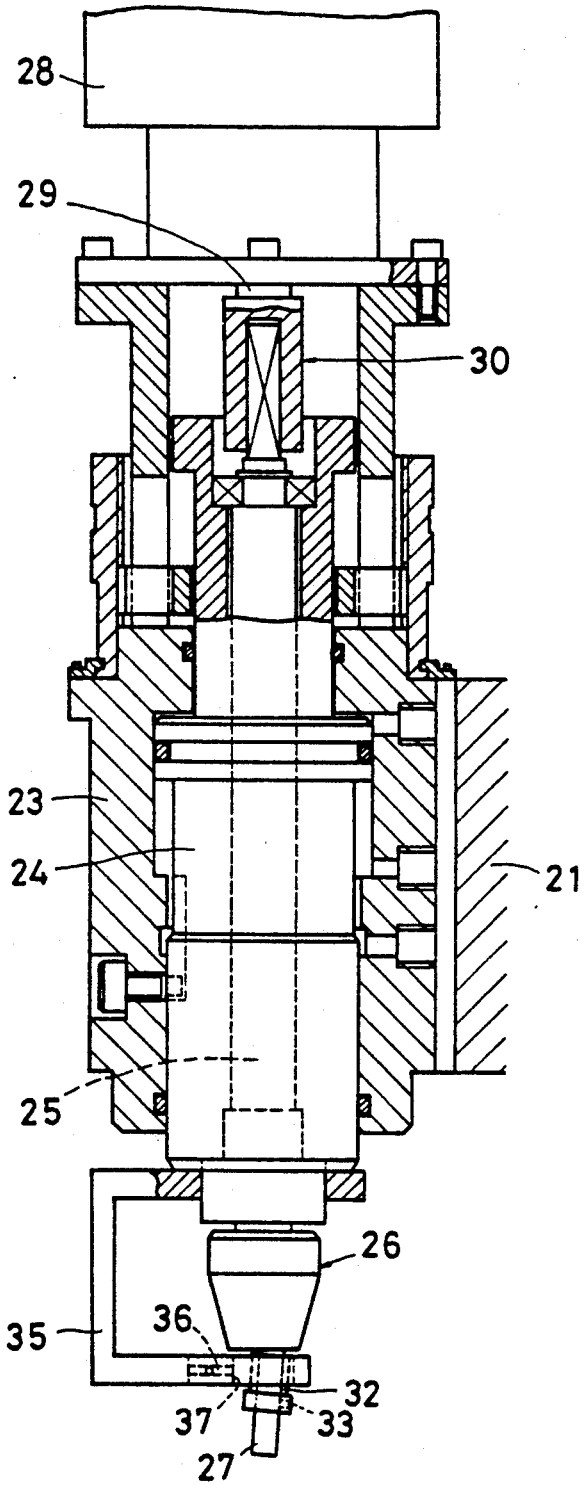
FIG. 2 is a partially cutaway enlarged side view of a portion of the same.
Figure 3:
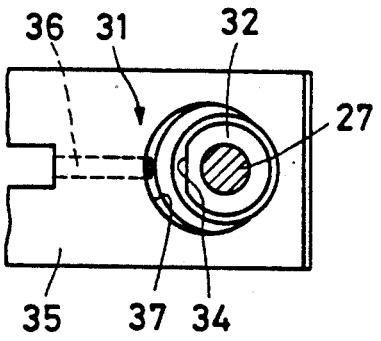
FIG. 3 is a cross-sectional plan view of the same.
Figure 4:
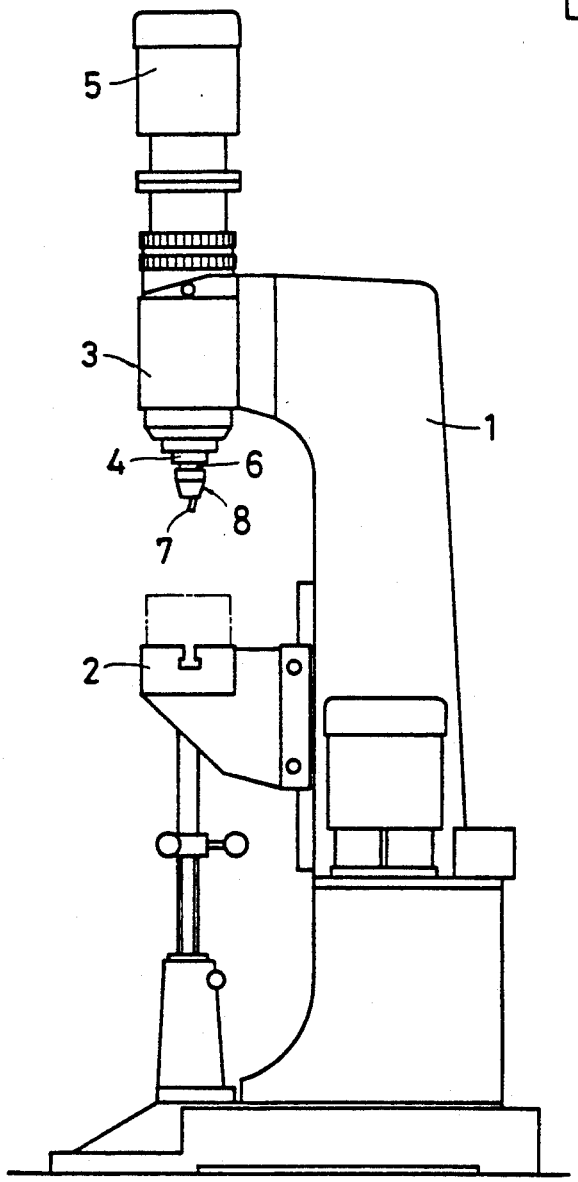
FIG. 4 PRIOR ART
FIG. 4 is a side view of a prior art caulking machine.

Now the embodiment of this invention will be described with reference to the accompanying drawings.

In the figures, numeral 21 designates an upright column extending from a base 22. A cylinder 23 is mounted on the top end of the column 21.

A piston shaft 24 is mounted in the cylinder 23 so as to be moved up and down by operating the cylinder. A spindle 25 extends coaxially through the piston shaft 24 and is rotatably supported in position.

A rivet head forming tool 26 is mounted on the bottom end of the spindle 25. Since the rivet head forming tool 26 is well-known in the art, its detailed structure is not shown. It includes a main body and a forming shaft 27 and is mounted so that its forming shaft 27 will pivot with its axis inclined and so that the center of the bottom end of the forming shaft 27 is aligned with the axis of the spindle 25.

A motor 28 is mounted directly over the cylinder 23. Its driving force is transmitted to the spindle 25 through its output shaft 29 and a retractable joint 30.

In the illustrated embodiment, the retractable joint 30 comprises a square shaft slidably coupled in a square hole for transmitting rotation. But it may have any other suitable structure.

Numeral 31 designates a detecting means for measuring the rotation of the forming shaft 27. The detecting means 31 includes a cylindrical body (or detected member) 32 which has a reflective surface 34 thereon, and a light-emitting and light-receiving sensor 36. In the illustrated example, the cylindrical body (or detected member) 32 is inserted from the bottom end of the forming shaft 27 and fixed thereto by a mounting screw 33. The reflective surface 34 is formed on an outer periphery of the cylindrical body 32 by a flat mirror finishing or a reflecting plate mounted on the cylindrical body 32. Further, the light-emitting and light-receiving sensor 36 of the detecting means 31 is mounted on an arm 35 fixed to the bottom end of the piston shaft 24 and adapted to move up and down together with the piston shaft 24 so as to be located opposite to the cylindrical body 32. Alternatively, detecting means may be made up of a protrusion provided on the outer periphery of the forming shaft 27 and a light emitter and a light receptor supported on an arm so as to be positioned opposite to the protrusion.

With this arrangement, by operating the cylinder 23, the spindle 25 is lowered together with the piston shaft 24 to press the forming shaft 27 of the rivet head forming tool 26 against the rivet shank. During this operation, the forming shaft should ideally not rotate at all when the rivet head forming tool is rotated. In other words, there should be no relative slip between the forming shaft and the rivet. Otherwise, the if any, should be as small as possible. Namely, the forming shaft 27 should not make one rotation or more per main body rotation of the rivet head forming tool 26.

During idling (when there is no rivet in place), the forming shaft 27 makes one rotation per rotation of the rivet head forming tool 26.

Thus, by measuring the rotation of the forming shaft 27 by means of the detecting means 31, it can be determined whether the rivet is being formed or the machine is idling. If the machine is found to be idling, a display device (not shown) such as a light or an alarm may be activated to give notice of the fact that there is no rivet or the operation of the caulking machine may be stopped.

In the drawings, numeral 37 designates a hole formed in the arm 35 through which the forming shaft 27 extends. 38 is a table secured to the column 21.

What is claimed is:

1. A rivet head forming machine comprising;

a column;

a table mounted to said column and being adapted to receive a workpiece having rivet shanks passing therethrough;

a piston shaft vertically movably mounted to said column;

a spindle rotatably mounted to said piston shaft for rotation about a rotation axis;

a rivet head forming tool secured to said spindle and including a main body and a rivet head forming shaft mounted in said main body; and a rivet detecting means for determining whether a rivet shank is present in the workpiece beneath said rivet head forming shaft by measuring rotation of said rivet head forming shaft about said rotation axis.

2. A rivet head forming machine as recited in claim 1, wherein said rivet detecting means comprises an arm fixed to said piston shaft, a detected member fixed on said rivet head forming shaft, and a detecting member mounted on said arm opposite said detected member.

3. A rivet head forming machine as recited in claim 2, wherein said detected member includes a reflective surface; and said detecting member comprises a light emitting and light receiving sensor.

4. A rivet head forming machine as recited in claim 2, wherein said rivet head forming shaft is inclined relative to said rotation axis; and said rivet head forming shaft is adapted to be pressed against the rivet shank and wobbled about a pivot point to form a rivet head on the rivet shank when said piston shaft is vertically moved relative to said column and said spindle is rotated relative to said shaft, and said rivet head forming shaft is adapted to idly rotate about said rotation axis when a rivet shank is not in place through the workpiece beneath said rivet head forming shaft and said spindle is rotated relative to said shaft.

5. A rivet head forming machine as recited in claim 1, wherein said rivet head forming shaft is inclined relative to said rotation axis; and said rivet head forming shaft is adapted to be pressed against the rivet shank and wobbled about a pivot point to form a rivet head on the rivet shank when said piston shaft is vertically moved relative to said column and said spindle is rotated relative to said shaft, and said rivet head forming shaft is adapted to idly rotate about said rotation axis when a rivet shank is not in place through the workpiece beneath said rivet head forming shaft and said spindle is rotated relative to said shaft.

* * * * *